United States Patent [19]

Doucet

[11] Patent Number: 4,577,744

[45] Date of Patent: Mar. 25, 1986

[54] MULTICOIN DISCRIMINATOR

[76] Inventor: Joël Doucet, 15, rue Roger Salengro, 92130 Issy-les-Moulineaux, France

[21] Appl. No.: 437,145

[22] Filed: Oct. 27, 1982

[30] Foreign Application Priority Data

Oct. 27, 1981 [FR] France ..... 81 20170

[51] Int. Cl.[4] ..... G07F 3/02

[52] U.S. Cl. ..... 194/318; 194/334; 194/335

[58] Field of Search ..... 133/3 C, 3 R, 3 D, 3 H, 133/8 R; 194/100 A, 99, 102, 1 K, 97 R, 100 R, 97 A; 324/229

[56] References Cited

U.S. PATENT DOCUMENTS

| | | | |
|---|---|---|---|
| 3,506,104 | 4/1970 | Kaiser et al. | 194/102 |
| 3,978,962 | 9/1976 | Gregory, Jr. | 194/97 A |
| 4,089,400 | 5/1979 | Gregory, Jr. | 194/99 X |
| 4,333,557 | 6/1982 | Kozak | 194/99 X |

FOREIGN PATENT DOCUMENTS

| | | |
|---|---|---|
| 2448752 | 2/1980 | France . |
| 2461987 | 7/1980 | France . |
| 2466055 | 7/1980 | France . |

*Primary Examiner*—Stanley H. Tollberg

*Attorney, Agent, or Firm*—Lowe, King, Price & Becker

[57] ABSTRACT

A coin discriminator comprises photoreceivers along a vertical drawn from an infed coin run chute whereby screening and illuminating the photoreceivers from a photoemissive source permit coin diameter identification. Two coils on either side of the chute detect the coin alloy. Coin thickness is determined using a step-shaped transversal section across the chute track where the step risers lie opposite the photoreceivers which transmit a signal word identifying the infed coin diameter and thickness. This signal word is compared with memorized words representative of acceptable coin dimensions. If the dimensions are acceptable, a combination of impedances in a bridge circuit incorporating the coils is selected in terms of the alloy corresponding to the acceptable dimensions. If the bridge balances for this combination as the coin rolls between the coils, the coin is accepted.

51 Claims, 14 Drawing Figures

MULTICOIN DISCRIMINATOR

BACKGROUND OF THE INVENTION

1. Field of the Invention

This invention relates to a multicoin (multitoken) discriminator comprising a chute having a vertically inclined track on which infed coins (tokens) roll. The coin discriminator is intended for an automatic object or service vending machine.

2. Description of the Prior Art

Multicoin discriminators as described in French patent applications 2,461,987 and 2,466,055 comprise coin dimension recognizing means in the form of two electromagnetic field producing coils on either side of the coin roll-in chute. The diameters of the coils are such that the upper tip of a coin having a minimum acceptable diameter enters only a small portion of the coil electromagnetic field; a coin having the maximum acceptable diameter enters the entire electromagnetic field. One of the coils, referred to as an oscillating coil, is connected to an oscillating circuit which delivers a high frequency signal, typically 100 kHz. The other coil, a so-called receiving coil, transmits a voltage to voltage comparison means; the voltage is proportional to the magnetic flux intensity through which the upper part of each coin passes. Reference voltages representative of the diameters of varying acceptable coin types are compared with the voltage transmitted by the receiving coil to deduce whether the coin should be accepted; if the coin is acceptable it has a diameter between the minimum and maximum diameters; otherwise the coin is refused.

In the foregoing patent applications, the coin alloy detecting means make use of the same voltage comparison principle.

Another coin discriminator, disclosed in French patent application 2,448,752, selects only one type of coin, i.e., admits only coins having a predetermined diameter and made of a predetermined alloy or material.

The principle behind the means for recognizing alloys resides in the description hereinabove. The alloy recognizing means also comprises two coils disposed opposite each other. One of the coils is excited by an a.c. generator. A signal induced in the other coil has an amplitude that is compared with a predetermined voltage to determine if the coin between the coils is acceptable; if the amplitude is less than the predetermined voltage the coin is acceptable.

The coin dimension recognizing means taught in French patent application 2,448,752 comprises two light sources and phototransistor light detecting pairs. The light detectors are spaced from each other by a distance virtually equal to the acceptable coin type diameter. Should one or both the phototransistors be excited, the infed coin does not have the required diameter and is rejected.

Known previous discriminators thus adopt coin diameter and alloy as the sole selection criteria. An infed coin having the acceptable diameter and alloy is therefore accepted regardless of thickness. This offers a further non-negligible opportunity of fraudulently introducing improper coins or slugs into the vending machine. Moreover, the diameter recognizing means taught in French patent application 2,466,055 permits acceptance of coins having diameters that vary over only a relatively small range. If the vending machine is to accept coins having many different diameters, the measurement device for distinguishing between the diameters require high sensitivity and very precise setting; the number of voltage comparing circuits equals the number of different diameters. The alloy recognizing means also requires a number of voltage comparing circuits equal to the number of denominations to be detected.

OBJECTS OF THE INVENTION

The main object of this invention is to provide a multicoin discriminator which discriminates infed coins in terms of the coin thickness.

Another object of this invention is to provide a multicoin discriminator which discriminates the infed coins in terms of the coin diameter, thickness and alloy.

A further object of this invention is to provide a multicoin discriminator in which the dimension recognizing means and the alloy recognizing means are unique and utilized for all coin types.

SUMMARY OF THE INVENTION

To discriminate coins in terms of diameter and thickness, a multicoin discriminator in accordance with one embodiment of the invention, comprises photoemission means lodged in one of the side walls of the coin chute for selectively illuminating photoreceptive means lodged on the other side wall of the chute and in front of the photoemissive means for detecting the dimensions of the infed coins. A stair-shaped transversal cross-section between the photoemissive means and photoreceptive means positioned in the bottom of the chute has its lowest step or platform adjacent an inclined side wall of the chute against which one face of the coins rests.

The photoreceptive means can comprise several charge transfer devices (CTD) or several phototransistors aligned respectively opposite to risers of the stair-shaped transversal cross-section and likely to capture the preferable infrared rays emitted by the photoemissive means.

The stair cross-section in the track provides thickness differentiation regarding the acceptable coins. By screening the photosensitive receivers opposite the risers and other photosensitive receivers above the step, a binary word is produced which identifies the diameter thickness of each acceptable type of coin. Recognition of acceptable dimensions is achieved by means connected to the photosensitive receivers for detecting a diameter and thickness identification word for each coin fed into the chute, a memory having memorized words respectively identifying the acceptable coin dimensions and means for comparing each detected word with the memorized words in order to accept or reject the infed coin.

According to another aspect of the invention, the stepshaped transversal cross-section is replaced by an inclined plane cross-section making a predetermined acute angle with the inclined side wall of the chute.

To discriminate coins in terms of alloy, a multicoin discriminator comprises two series-connected coils on opposite sides of said chute for detecting the alloy of each infed coin, oscillator means having a predetermined-frequency, and means for memorizing words representating the alloys of acceptable coins. Two combinations of parallel impedances are respectively addressable by all said memorized words for each infed coin. An impedance bridge means excited by said oscillator means has four arms, one of which includes the two series-connected coils. Two adjacent arms respectively include the two parallel impedance combinations. A bridge means balance detection means compares the detected alloy of each infed coin with all said alloys representated by said memorized words to accept or reject said infed coin.

According to other aspects of the invention, a complete multicoin discriminator embodying the invention comprises the above diameter and thickness discriminating means and the above alloy discriminating means. One of these two discriminating means can accept an infed coin after the other has detected and validated the infed coin in terms of the diameter and thickness, and the alloy.

Other features, advantages and objects of this invention will be more clearly apparent from the following description of preferred exemplified embodiments as illustrated in the accompanying corresponding drawing.

DESCRIPTION OF THE PREFERRED EMBODIMENTS

Figure 1:
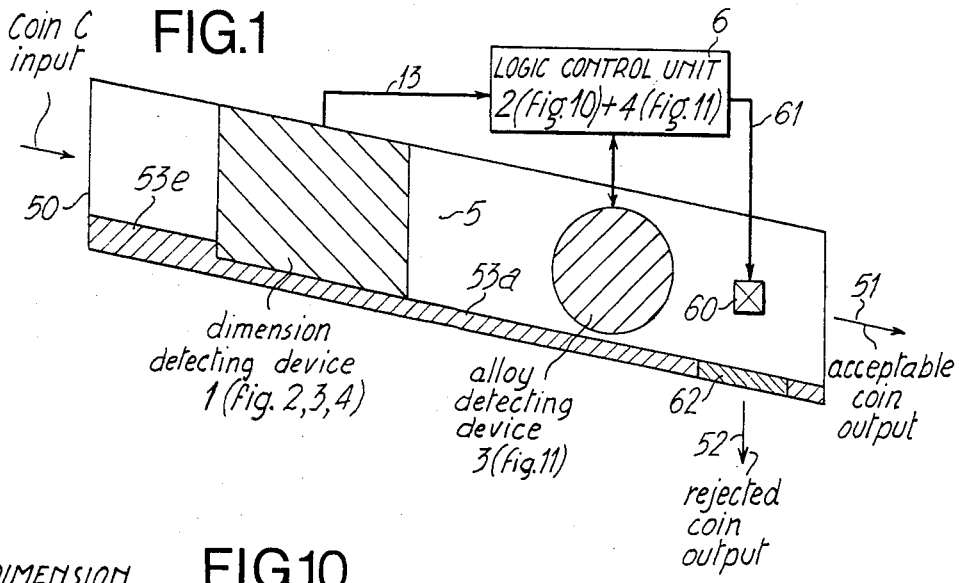
FIG. 1 is a schematic longitudinal cross-section view along the coin chute of the position of the various means incorporated in a multicoin discriminator embodying the invention.

Schematically depicted in FIG. 1 is a discriminator for coins or tokens presenting different diameters, thickness and alloys. The discriminator includes coin C dimension recognizing means 1—2 and coin C alloy recognizng means 3—4. Each of these means comprises a coin detecting device 1, 3 that is located along chute 5 for the coin C gravity infed run and a circuit 2, 4 associated with respective detecting device 1, 3 for comparing the detected dimensions or alloy with the pre-recorded values therefor. Circuits 2 and 4 are included in a logic control unit 6 which, from the comparison results, determines whether an infed coin is to be accepted and honored or rejected and reimbursed.

The multicoin discriminator is located in a known object or service vending machine. Mention is made henceforth solely of those means in this machine directly related to the multicoin discriminator.

As shown in FIG. 1, run chute 5 has an input 50 having a single slot into which the coins are fed, and a double output 51—52. The double output consists of a first output 51 for acceptable coins that fall into a collection box in the vending machine and a second output 52 for the rejected coins above the vending machine reimbursement receptacle. The chute output selection between the accepted and rejected coins is obtained by means of an electromagnet 60 that is controlled by unit 6 through a wire 61. Electromagnet 60 holds the bottom of the run chute open by means of a retractable hatch 62 until such time as the relative dimension or alloy comparisons are no longer negative.

Run chute 5 generally has a rectangular cross-section and descends along a track 53 from input 50 down to output 51—52. In the illustrated embodiment, starting from input 50, a coin first crosses dimension detecting device 1 and then crosses alloy detecting device 3.

Figures 2, 3, 4:
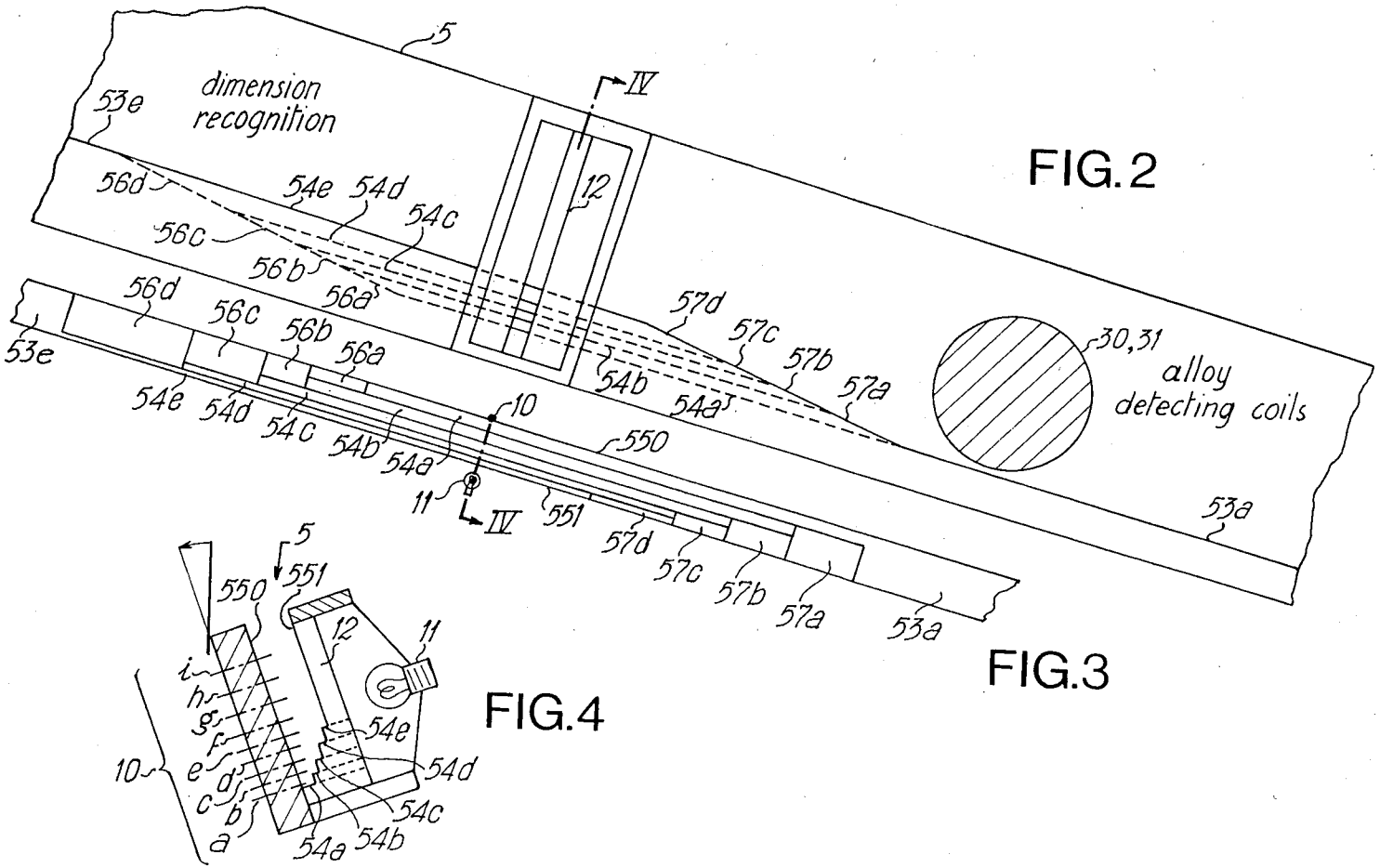
FIG. 2 is a side view of the chute having a step-shaped transversal cross-section.
FIG. 3 is a plan view of the chute track of FIG. 2.
FIG. 4 is a cross-sectional view along the line IV—IV in FIGS. 2 and 3.

In reference now to FIGS. 2 and 4, the width of chute track 53 is equal to the largest acceptable coin thickness. Track plane 53*e* at the input 50 end is a higher level than plane 53*a* of the track running from device 3 down to output 51—52. Between parallel planes 53*e* and 53*a* that have the same direction if inclination, the track is formed as a staircase having plural risers and platforms (steps) in cross-section at right angles to the rolling direction of coin C as illustrated in FIG. 4. The stepped section is illustrated as comprising three intermediate steps 54*b*, 54*c*, and 54*d*, located between lower step 54*a* and upper step 54*e*. Steps 54*a* and 54*e* are coplanar with the track planes 53*a* and 53*e* respectively.

Moreover, longitudinal side walls 550 and 551 of chute 5 are rearwardly inclined such that gravity causes all the coins to rest on lower wall 550.

As shown in FIG. 3, the longitudinal transitions or risers between plane 53*e* that is an extension of upper step 54*e*, and following step 54*d*, between steps 54*d* and 54*c*, between steps 54*c* and 54*b* and between step 54*b* and lower plane 53*a* that is an extension of step 54*a*, are respectively formed of rectangular inclined planes 56*d*, 56*c*, 56*b* and 56*a*. These inclined planes adjoin wall 550 against which one of the coin faces rests by gravity. Downstream of device 1 and upstream of device 3, the chute further comprises inclined planes 57*d* and 57*a* which form respective transitions between steps 54*e* to 54*a*; planes 57*a*–57*d* are adjacent upper longitudinal wall 551. As can be seen in FIG. 3, steps 54*e* to 53*a* between walls 551 and 550 form longitudinal parallel strips, each off-set with respect to the previous one down to the output.

The inclined planes provide a progressive descent for coins with differing thickness between upper plane 53*e* and lower plane 53*a* of the track. It goes without saying that other configurations and longitudinal lay-outs of the inclined planes may be envisioned.

Generally speaking, each stair in the staircase has a different height and width.

Figure 5:
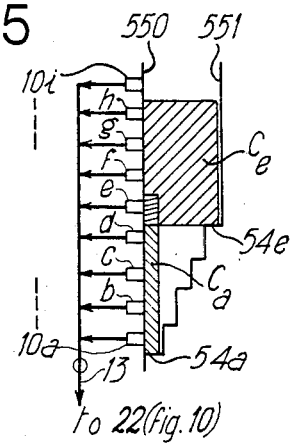
FIG. 5 is a cross view analogous to FIG. 4 of thin and thick coin runs.

The distances between rear support wall 550 and the risers and other wall 551 are slightly greater than the five different acceptable coin thickness. For example, as depicted in FIG. 5, a thin coin $C_a$ rolls from the upper track plane 53*e* successively over inclined planes 56*d* to 56*a* and along lower step 54*a* whereas a coin $C_e$ having a thickness greater than the distance between wall 550 and the upper riser and equal at the most to the width of chute 5, runs firstly over upper step 54*e* and then over inclined planes 57*d* to 57*a*.

Semiconductor photosensitive receivers 10*a* to 10*i* respond to light energy from source 11, as blocked by token or coin C, as it rolls through device 1 to enable the coin thicknesses and diameters to be detected. The length of a region of receivers 10*a* to 10*i* that is not illuminated determines the token diameter. The length of a zone of receivers 10*a* to 10*i* between lowest step 54*a* and the lowest edge of token C that is illuminated indicates the coin thickness; the coin thickness is detected only while the coin diameter is detected.

With reference to FIGS. 2 to 6, dimension detecting device 1 comprises a photoemissive source 11 and a plurality of photosensitive receivers 10*a* to 10*i* such as phototransistors. Photoemissive source 11 may emit optical energy in the visible band, but preferably is an infrared emitter to obviate any parasitic detection of light that might stem from coin input slot 50. Photoemissive source 11 includes either a lamp or a light-emitting diode (LED) or several photoemissive diodes. The photosensitive receivers can be replaced by any other electro-optical means such as charge transfer device (CTD) or camera, e.g. a bar of charged coupled devices (CCD) described in detail hereinafter. Photoemissive source 11 is fixed behind a slit 12 in upper side wall 551 of the chute and is perpendicular to chute track 53 and thus to all steps 54*e* to 54*a*. Phototransistors 10*a* to 10*i* are inserted in support wall 550 where they are also aligned with the vertical from track 53 in the transversal plane that is perpendicular to walls 550 and 551 and median to slit 12. The transversal plane follows line IV—IV in FIGS. 2 and 3 and lies in line with a step transversal section of track 53. Slit 12 can be replaced by holes formed in chute upper wall 551. One hole is provided for each of transistors 10*a* to 10*i*, so each is aligned with the vertical from chute track 53 and positioned opposite the phototransistor associated with it.

Figure 6:
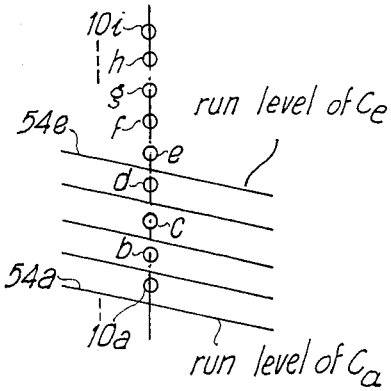
FIG. 6 is a schematic side view of the chute of FIG. 2 showing the positioning of the photosensitive receivers with regard to the risers of the step cross-section.

As illustrated in FIG. 6, lower phototransistors 10*a* to 10*d* are respectively positioned opposite the centers of the straight risers. In the drawing, phototransistors 10*e* to 10*i* are equally spaced between upper step 54*e* and the upper edge of wall 550. However, in practice, the number of phototransistors 10*a* to 10*i* can be greater and the phototransistors can be spaced from each other by distances associated with the various acceptable coin diameters. Last phototransistor 10*i* is usually slightly higher than the highest acceptable coin rolling down the step section in order to detect any improper coins or slugs having an excessive diameter.

As a result, depending on phototransistor screening and excitation, circuit 2 in logic unit 6 can deduce the diameter and thickness of a coin. When photoemissive source 11 excites a lower phototransistor 10*a* to 10*d*, the thickness of the coin is greater than the distance between support wall 550 and the corresponding riser. Between the highest excited lower phototransistor 10*a* to 10*d* and the lowest excited phototransistor, the other phototransistors are screened to indicate the coin diameter.

Figure 7:
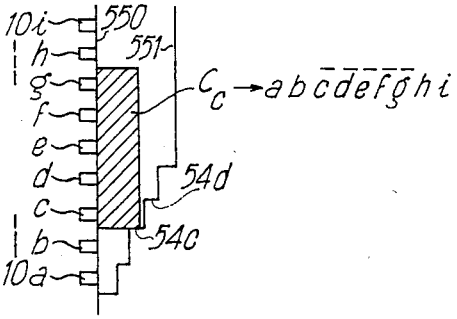
FIGS. 7, 8 and 9 are cross-sectional views analogous to FIG. 4 depicting the runs of two coins having different diameters and thickness and of a washer on a step.
Figure 8:
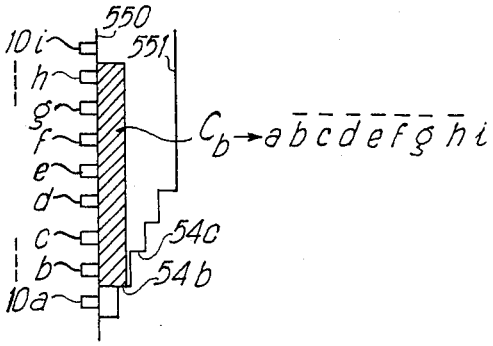
Figure 9:
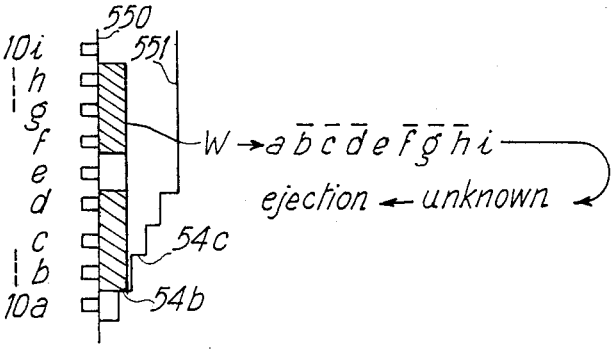

Three examples of coins to be detected are given in FIGS. 7 to 9. The high logic signals a to i indicate the respective excitation of phototransistors 10*a* to 10*i* whilst complementary logic signals $\bar{a}$ to $\bar{i}$ indicate the respective screening of phototransistors 10*a* to 10*i*.

As seen in FIG. 7, the width of an infed coin $C_c$ lies between the distances separating wall 550 from the risers of steps 54*c* and 54*d*. Coin $C_c$ therefore rolls along step 54*c*. The diameter of coin $C_c$ is slightly greater than the distance between phototransistors 10*c* and 10*g*. As a result, phototransistors 10*c* to 10*g* are screened and phototransistors 10*a*, 10*b*, 10*h* and 10*i* are excited by source 11. In this case, a bus 13 connected to the phototransistors delivers the detected word $a\ b\ \bar{c}\ \bar{d}\ \bar{e}\ \bar{f}\ \bar{g}\ h\ i$ to circuit 2.

Referring now to FIG. 8, the infed coin $C_b$ rolling along second step 54*b* has a diameter slightly greater than the distance between phototransistors 10*b* and 10*h*. The word detected and delivered along bus 13 is $a\ \bar{b}\ \bar{c}\ \bar{d}\ \bar{e}\ \bar{f}\ \bar{g}\ \bar{h}\ i$.

In FIG. 9, the coin W has the same dimensions as in FIG. 8, but has a hole drilled through the center thus forming a washer. The central hole of coin W enables radiation from source 11 to be incident on and excite phototransistor 10*e*, thus causing the word transmitted on bus 13 to be $a\ \bar{b}\ \bar{c}\ \bar{d}\ e\ \bar{f}\ \bar{g}\ \bar{h}\ i$. Consequently, when circuit 2 recognizes at least two separate signal groups at the lower level in the logic signal derived by detectors 10*a*–10*i*, it deduces that the infed coin has a hole through it; the coin is thus unacceptable and must be rejected by retracting hatch 62 controlled by eject electromagnet 60.

Should a buckled coin become jammed, means (not shown) can be provided for ejecting the coin manually or electromechanically into the reimbursement receptacle by off-setting at least chute support wall 550.

Figure 10:
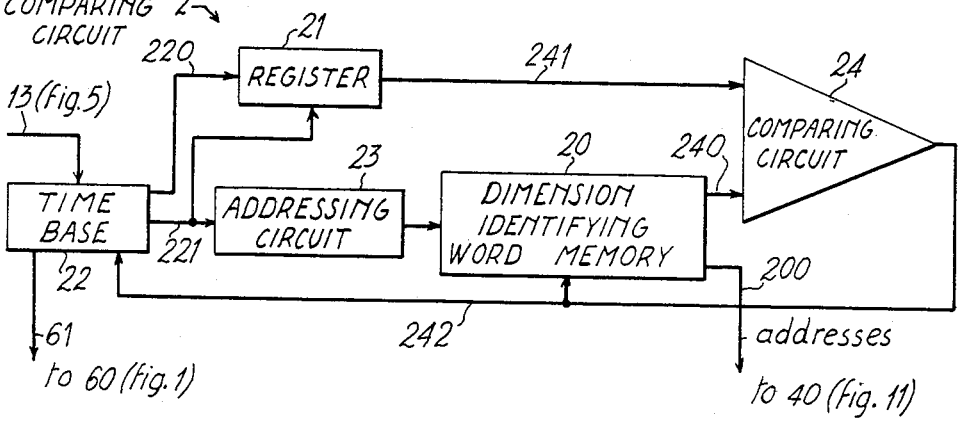
FIG. 10 is a block diagram of a dimension comparing circuit.

Each acceptable coin is characterized by a word identifying the coin diameter and the thickness. In the embodiment illustrated in FIG. 10, dimension comparing circuit 2 comprises a read-only memory (ROM) 20 having predetermined addresses containing nine-bit words respectively identifying the dimensions of all coin types the vending machine is supposed to accept. The memory 20 is preferably reprogrammable (REPROM) thus allowing the company managing the machine to select the acceptable coins in terms of the service or object vending cost.

Circuit 2 further comprises, in the embodiment illustrated, a buffer shift register 21 with at least nine stages, a time base 22, a read addressing circuit 23 for read-only memory 20 and a logic comparing circuit 24 having input buses 240, 241 connected to the parallel outputs of memory 20 and register 21. Bus 13 transmits the parallel bits of the dimension identifying binary words to time base 22.

Time base 22 periodically reads the words in bus 13 and includes means for successively comparing these words two by two in order to select and retain only that word having the greatest number of bits with the low logic level between two predetermined instants closely corresponding to a coin passing between slit 12 and phototransistors 10*a* to 10*i*. The selected word corresponds to the diametral section of the coin passing through the chute. Time base 22 then orders the following cycle.

The selected identification word is recorded in buffer register 21 via a bus 220. Next, via a lead 221, the time base simultaneously controls the reading of register 21 and the reading of a first acceptable coin dimension identifying word in memory 20 to addressing circuit 23. Comparing circuit 24 transmits the comparison result via output lead 242 thereof to time base 22. Until such time as the comparison result is no longer negative, the time base orders other acceptable coin identifying words memorized in read-only memory 20 to be read in order to compare them with the word detected and recorded in register 21.

Should no comparison be positive, time base 22 sends orders via wire 61 for the infed coin to be rejected by opening hatch 62. For a positive comparison, the memory 20 reading cycle is halted and an address is transmitted via bus 200 from memory 20 to an alloy memory 40 incorporated in alloy comparing circuit 4. Each coin dimension identifying word stored in memory 20 is stored with an address word from memory 40 which characterizes the alloy of that coin having acceptable dimensions corresponding to the identification word that is detected in the time base 22 and stored in the register 21 of circuit 2.

When the multicoin discriminator embodiment does not comprise device 3 and circuit 4, the address words for memory 40 go unused.

Figure 4B:
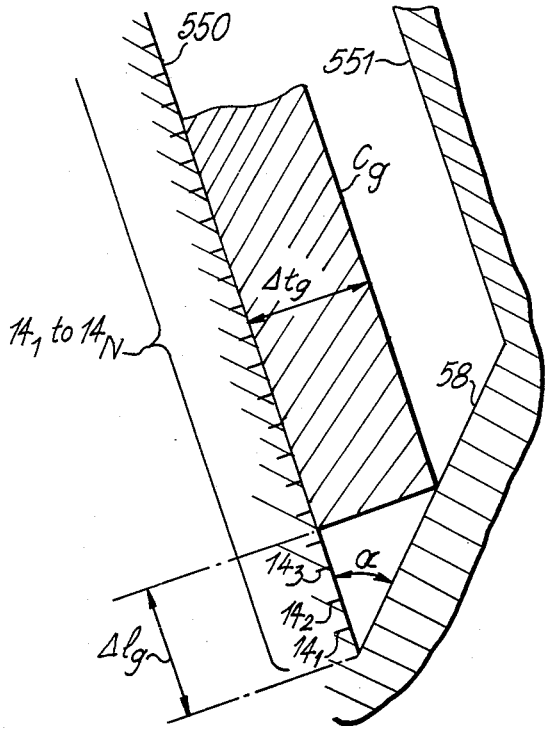
FIGS. 4A and 4B are cross-sectional views of a coin chute track having an inclined plane cross-section.
Figure 4A:
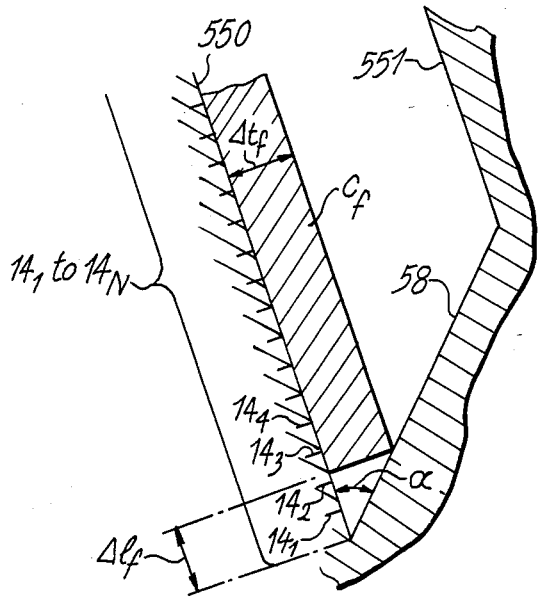

According to another embodiment illustrated in FIGS. 4A and 4B, the photoreceptive receiving means included in the dimension detecting device 1 includes a charge coupled device (CCD) bar. The N cells $14_1$ to $14_N$ of the CCD bar replace the phototransistors 10*a* to 10*i*. In practice, the integer N is higher than the number of phototransistors because of the integrated structure of the bar. The vertical definition with a CCD bar may reach at least a tenth of a millimeter. The CCD bar is lodged in the support side wall 550 and is perpendicular to the track 53 of the run chute 5 and opposite the slit 12.

As shown in FIGS. 4A and 4B, the steps 54*a* and 54*d* are replaced by an inclined plane 58 making a predetermined acute angle $\alpha$ with respect to the lower support wall 550. When an infed coin C rolls down chute 5, gravity causes one of its faces to rest against wall 550; the edge of its opposite face rolls on inclined plane 58 that is provided between upper track 53*e* and lower track 53*a*. As previously, the screened CCD cells, such as above cell $14_3$ for a thin coin $C_f$ having a thickness $\Delta t_f$ (FIG. 4A), or above cell $14_5$ for a thick coin $C_g$ having a thickness $\Delta t_g$ (FIG. 4B), give the diameter of the coin. The excited lower cells, such as cells $14_1$ and $14_2$ for coin $C_f$ or cells $14_1$ to $14_4$ for coin $C_g$, directly define the thickness $\Delta t$ of the coin according to the formula:

$$\Delta t = \Delta l \cdot t_g \alpha$$

where $\Delta l$ is the distance between the lower portion of the coin and the apex of angle $\alpha$, i.e. the length along which the lower cells are excited. Preferably, $\alpha$ is equal to $\pi/4$ to simplify the calculation since $\Delta t = \Delta l$ for this case.

The dimension comparing circuit according to this embodiment enables the coin diameter to be determined, as above mentioned. The dimension comparing circuit further enables the coin thickness to be directly determined in terms of the formula $\Delta t = \Delta l$ by comparing the word that is delivered from the lower excited CCD cells, with a memorized thickness identifying word for the corresponding diameter of an acceptable coin.

The multicoin discriminator according to this embodiment is suitable for all the acceptable coin types without mechanical modifications; on the contrary, the width of each step according to the first embodiment corresponds to a predetermined coin thickness. These modifications are only obtained by programming the acceptable coin thickness and diameter table that is stored in the reprogrammable memory (REPROM) in the circuit 2.

Figure 11:
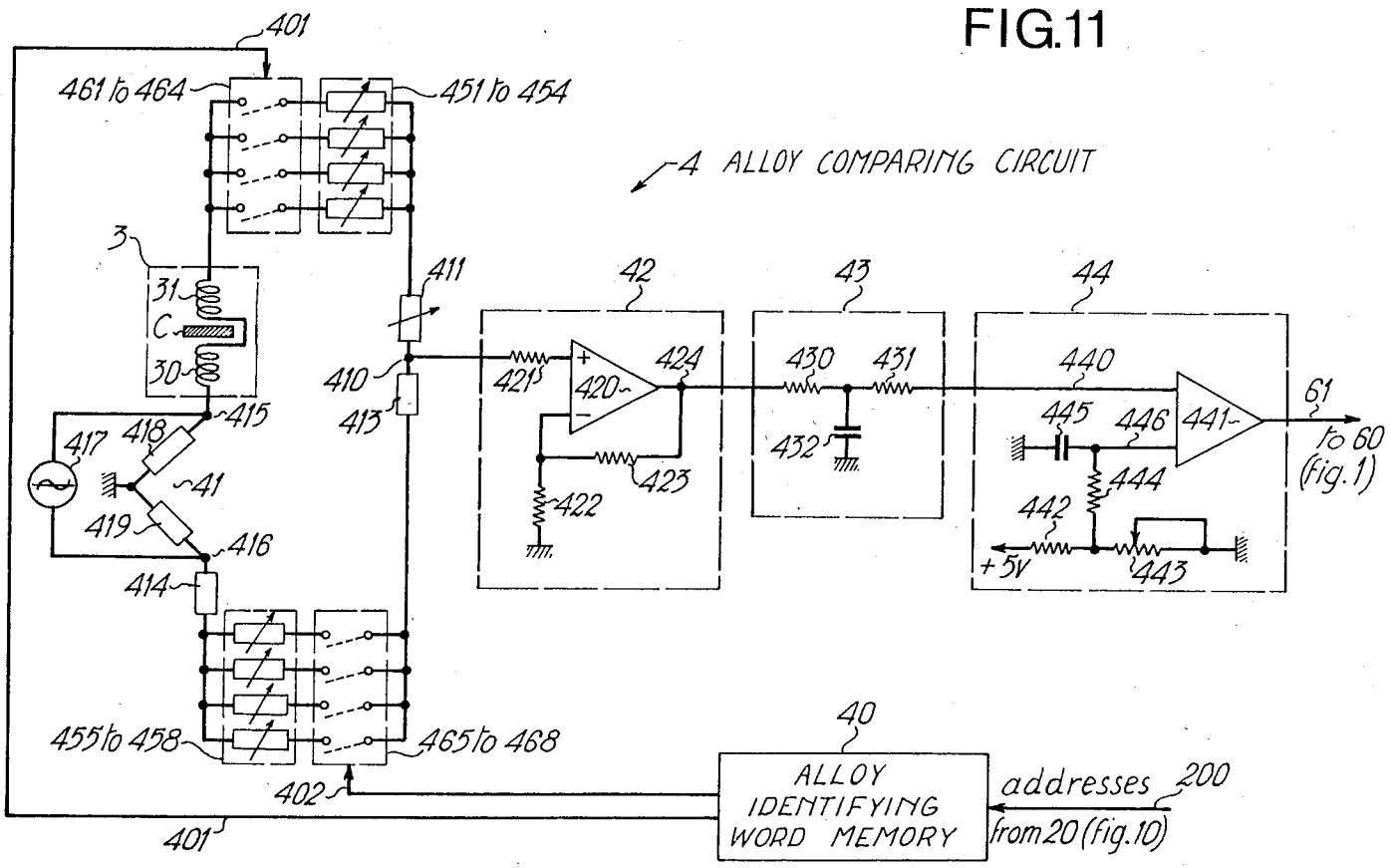
FIG. 11 is a block diagram of the alloy comparing circuit.

In reference now to FIG. 11, a description follows of alloy recognizing means 3-4.

Alloy detecting device 3 comprises, as is known, two electromagnetically coupled coaxial coils 30 and 31 opposite one another. Coils 30 and 31 are respectively inserted in longitudinal side walls 550 and 551 of run chute 5 above lower plane 53*a*. The common axis of coils 30 and 31 is perpendicular to walls 550 and 551 and preferably lies in line with the average center of the coins rolling along plane 53*a*, in line, for example, with that of upper step 54*e*.

Beside the already mentioned alloy identifying word memory 40, circuit 4 comprises a Wheatstone bridge circuit 41, an amplifying circuit 42, an integrating circuit 43 and a threshold comparing circuit 44.

Terminal 410, common to two adjacent arms in impedance bridge circuit 41, is connected via input resistor 421 to direct input $420_+$ of an operational amplifier 420 that is included in amplifying circuit 42. Each of these two arms has a plurality of parallel-connected circuits 451–461 to 454–464, 455–465 to 458–468, numbering in this four, for instance. Each of these circuits comprises a complex impedance 451 to 458 (that may be adjustable) and an analog switching circuit 461 to 468 of the relay-controlled contact type, resistor type or the RCA CD4066 "analog switch" type for example. The first of the foregoing arms (the upper one in FIG. 11) comprises, in series with four parallel-connected circuits 451–461 to 454–464, two series-connected coils 30 and 31 together with a complex impedance 411 that may include a thermistor. The second foregoing arm (the lower one in FIG. 11) comprises two impedances 413 and 414 that are respectively and preferably resistive and capacitive and are connected in series with the other four parallel-connected circuits 455–465 to 458–468.

Applied to the other terminals 415–416 of the foregoing arms of bridge circuit 41 is the voltage from a.c. generator 417 having a predetermined-frequency suitable for discriminating between coin alloys. Between terminals 415 and 416 are the third and fourth arms Wheatstone bridge circuit 41, respectively comprising impedances 418 and 419, that are preferably resistive and capacitive and are connected to ground.

In analog amplifying circuit 42, inverse input terminal $420_-$ of amplifier 420 is connected to grounded resistor 422, and a feedback resistor 423 that is connected to output 424 of amplifier 420.

Integrated circuit 43 comprises two resistors 430 and 431 having a common terminal connected to a grounded capacitor 432. The other terminal of resistor 431 is connected to one of inputs of the voltage comparator 411 which is included in circuit 44.

Threshold comparing circuit 44, between the positive supply terminal and ground, further includes a resistor 442 and a potentiometer 443, having a common terminal connected to a resistor 444. The other terminal of resistor 444 is connected to a common terminal of grounded capacitor 445 and input 446 of comparator 441. The output of comparator 441 is connected via controlling wire 61 to electromagnet 60 for ejecting refused coins. Potentiometer 443 is set such that the voltage across comparator terminal 446 is equal to the bridge circuit 41 balance voltage applied to terminal 440 via circuits 42 and 43.

Each group of analog switches 461 to 464, 465 to 468 is controlled by a 4-lead output bus 401, 402 from alloy identifying word memory 40. Prior to any utilization of the device, adjustable impedances 451 to 458 are set such that for certain open and closed combinations of switches 461 to 468, i.e. predetermined impedance 451 to 458 combinations, each of the alloys or materials characterizing all the acceptable coins introduced between coils 30 and 31 indicates the bridge circuit balance status; the bridge balance status is indicated by a high logic level output signal on wire 61. An alloy identifying word in reprogrammable read-only memory 40 (REPROM) corresponds to each switch open/close or impedance combination for each predetermined alloy.

Subsequent to time base 22 (FIG. 10) enabling the diameter and thickness dimension for an infed coin in response to recognition of a dimension identifying word transmitted along bus 13 and stored in memory 20, memory 20 delivers to bus 200 the alloy identifying word address that is memorized in the memory 40 and which corresponds to the alloy of an acceptable coin with the detected dimensions; bus 200 is supplied with the alloy word after a lapse of time corresponding to the time the coin takes to run between devices 1 and 3. Switches 461 to 468 are controlled via buses 401 and 402 and positioned to enable the corresponding alloy to be detected. If the infed coin causes bridge circuit 41 to be balanced upon running between coils 30 and 31, comparator 441 activates ejection electromagnet 60 (FIG. 1) to close hatch 62 over which the coin rolls towards the output 51 and the collection box. In the opposite case, if the coin has the appropriate dimensions, but bridge 41 is not balanced since the coin composition does not correspond to the required alloy for such dimensions, the low level signal on wire 61 holds hatch 62 open and the coin is returned to the user.

In the embodiment wherein the multicoin discriminator comprises only means for recognizing alloys 3–4, circuit 4 fulfills functions analogous to circuit 2. In this case, circuit 4 comprises a time base 22 which successively readouts addresses of the alloy identifying words in memory 40 until the time base detects a low level signal at the output of comparator 441; the low level output enables the infed coin. Alternatively, if the output of comparator 441 indicates no balance of bridge circuit 41 for all the close/open combinations of analog switches 461 to 468 stored in memory 40, hatch 62 stays open to reject the unacceptable coin.

In a further embodiment, alloy detecting device 3 can be located upstream of dimension detecting device 1 along the chute 5 coin track. In this case, the relative control functions of circuits 2 and 4 are reversed. Circuit 4 comprises a time base 22 which cyclically reads memory 40 until bridge circuit 41 is detected as balanced. In response to this balance, memory 40 addresses memory 20 so comparator 24 can compare the word on bus 13 with that addressed in memory 20. As previously, if the bridge circuit is balanced and if, for this balance, the comparison result in comparator 24 is positive, hatch 62 is activated to close the chute track.

Figure 12:
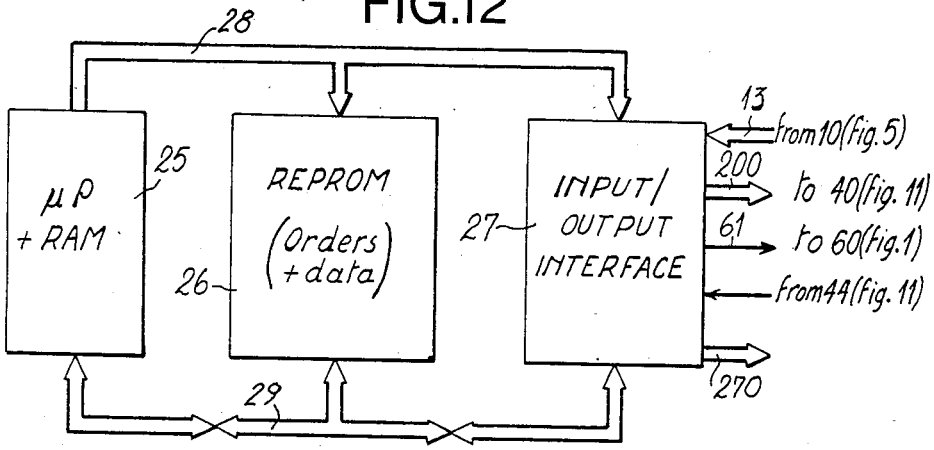
FIG. 12 is a block diagram of the dimension comparing circuit structured around a microprocessor according to another embodiment.

Lastly, in a more integrated embodiment, dimension recognizing circuit 2 is structured around a microprocessor 25, as shown in FIG. 12. The microprocessor 25 comprises a random access memory (RAM) that is utilized for successive two-by-two comparisons of the words coupled to bus 13 as the coin rolls through the chute. Circuit 2 further comprises a reprogrammable memory 26 and an input/output interface 27. Prerecorded in memory 26 are the acceptable coin dimension identifying words and the orders corresponding to the comparison cycle, as described herein with reference to FIG. 10. Circuits 25, 26 and 27 are interconnected conventionally via a unidirectional bus 28 for the addresses leaving microprocessor 25 and via a bidirectional bus 29 for the orders and data. Interface 27 is linked to bus 13, connected to photoemissive means 10*a* to 10*i* (FIG. 5) or $14_1$ to $14_N$ (FIGS. 4A and 4B); bus 200, serving alloy identifying word memory 40 (FIG. 11), controls wire 61 of electromagnet 60 that controls retractable hatch 62 (FIG. 1), and directly, in this case, to respond to the output of voltage comparator 44 (FIG. 11). Bus 270 can connect interface 27 to other equipment, such as a display means. In this microprocessor embodiment, memory 40 (FIG. 11) can also take the form of a microprocessor.

What I claim is:

1. A multicoin discriminator comprising a chute having a vertically inclined track on which coins roll, and an inclined side wall against which one face of said coins rests as the coins roll on the inclined track, and means including photoreceptive means and photoemissive means on opposite sides of said chute for detecting the dimensions of said coins, said chute track in front of said dimension detecting means having a cross-section transverse to the direction the coin rolls along the inclined track, the cross-section being shaped as a staircase having plural steps each having a riser and landing, the spacings between the inclined wall and each riser being approximately equal to the thicknesses of acceptable coins, the spacings between adjacent landings being approximately equal to the difference in radii of acceptable coins, the landing of the lowest step abutting against the inclined wall.

2. The multicoin discriminator claimed in claim 1 wherein said photoreceptive means comprises photosensitive receivers respectively opposite the risers of said stair-shaped transversal cross-section and excitable by said photoemissive means.

3. The multicoin discriminator claimed in claim 2 wherein said photoreceptive means comprises photosensitive receivers above the upper step of said stair-shaped transversal cross-section and excitable by said photoemissive means.

4. The multicoin discriminator claimed in claim 1 wherein the ends of the steps of said stair-shaped transversal cross-section are interlinked to said chute track through longitudinal inclined planes.

5. The multicoin discriminator claimed in claim 2 wherein the photosensitive receivers are charge transfer devices.

6. A multicoin discriminator as claimed in claim 2 comprising a slit perpendicular to the steps of said step-shaped transversal cross-section and make in one of the chute walls in front of said photoemissive means, said photosensitive receivers being aligned opposite to said slit in the other chute wall.

7. A multicoin discriminator as claimed in claim 2 comprising holes aligned perpendicular to the steps of said step-shaped transversal cross-section and make in one of the chute walls in front of said photoemissive means, said photosensitive receivers being respectively aligned opposite to said holes in the other chute wall.

8. The multicoin discriminator claimed in claim 2 wherein said photoemissive means emits in the infrared band.

9. A discriminator for multiple coins having different diameters and thicknesses comprising a chute having a vertically inclined track on which coins roll, an inclined side wall against which one face of said coins rests, and means including photoreceptive means and photoemissive means on opposite sides of said chute for detecting the dimensions of said coins, characterized in that said chute track in front of said dimension detecting means has an inclined plane cross-section making a predetermined acute angle with said inclined side wall of said chute, said photoemissive means and photoreceptive means, track and side wall being arranged so: (a) a first portion of said photoreceptive means is screened by a coin rolling on the track between the photoemissive means and photoreceptive means to estimate the diameter of said coin, (b) a second portion of said photoreceptive means is located below said coin and is irradiated by energy from said photoemissive means to contribute to an estimate of the thickness of a coin rolling on the track between the photoemissive means and photoreceptive means; and means responsive to said second portion of said photoreceptive means for estimating the thickness of said rolling coin in terms of said acute angle.

10. The multicoin discriminator claimed in claim 9 wherein said predetermined angle is equal to $\pi/4$.

11. The multicoin discriminator claimed in claim 9 wherein said photoreceptive means comprises several photosensitive receivers opposite to said inclined plane cross-section and excitable by said photoemissive means.

12. The multicoin discriminator claimed in claim 11 wherein said photoreceptive means comprises several photosensitive receivers above said inclined plane cross-section and excitable by said photoemissive means.

13. The multicoin discriminator as claimed in claim 11 wherein said photosensitive receivers are charge transfer devices.

14. A multicoin discriminator as claimed in claim 11 comprising a slit in one of said chute wall in front of said photosensitive means, said photoemissive receivers being aligned opposite to said slit in the other chute wall.

15. A multicoin discriminator as claimed in claim 11 comprising holes aligned in one of said chute walls in front of said photosensitive means, said photoemissive receivers being respectively aligned opposite to said holes in the other chute wall.

16. The multicoin discriminator claimed in claim 11 wherein said photoemissive means emits in the infrared band.

17. A multicoin discriminator comprising a chute having a down inclined track on which infed coins roll, an inclined side wall against which one face of said infed coins rests, and a step-shaped transversal cross-section, whose lowest step is adjacent to said inclined side wall of said chute, photoemissive means lodged in one of the side walls of said chute and in front of said step-shaped transversal cross-section, photoreceptive means excitable by said photoemissive means and lodged in the other side wall of said chute and in front of said step-shaped transversal cross-section and said photoemissive means for detecting the diameter and the thickness of each infed coin thereby delivering an infed coin dimension representating word, means for memorizing words representating the diameter and the thickness of acceptable coins respectively, and means connected to said photoreceptive means and said memorizing means for comparing said infed coin dimension representating word with all said memorized words thereby accepting or refusing said infed coin.

18. A multicoin discriminator as claimed in claim 17 wherein said step-shaped transversal cross-section is replaced by an inclined plane cross-section making a predetermined acute angle with said inclined side wall of said chute.

19. A multicoin discriminator comprising a chute having a down inclined track on which infed coins roll, and two opposite side walls, two series-connected coils on either side of said chute detecting the alloy of each infed coin, predetermined-frequency oscillating means, means for memorizing words representating the alloys of acceptable coins respectively, two combinations of parallel impedances respectively addressable from all said memorized words for each infed coin, an impedance bridge means excited by said oscillating means and having one of its four arms including said two series-connected coils and two adjacent arms including said two parallel impedance combinations respectively, and bridge means balance detection means for comparing the detected alloy of each infed coin with all said alloys representated by said memorized words thereby accepting or refusing said infed coin.

20. The multicoin discriminator claimed in claim 19 wherein said bridge means balance detection means comprising an integrating circuit and a threshold comparing circuit.

21. The multicoin discriminator claimed in claim 19 wherein said bridge means arm including said two coils comprises a thermistor.

22. A multicoin discriminator comprising:

a chute having a down inclined track on which infed coins roll, an inclined side wall against which one face of said infed coins rests, and a step-shaped transversal track cross-section, whose lowest step is adjacent to said inclined side wall of said chute, photoemissive means lodged in one of the side walls of said chute and in front of said step-shaped transversal cross-section, photoreceptive means excitable by said photoemissive means and lodged in the other side wall of said chute and in front of said step-shaped transversal cross-section and said photoemissive means for detecting the diameter and the thickness of each infed coin thereby delivering an infed coin dimension representating word, first means for memorizing words representating the diameter and the thickness of acceptable coins respectively, two series-connected coils inserted on either side of said chute and following after said photoemissive and photoreceptive means in the infed coin run direction in said chute for detecting the alloy of each infed coin, predetermined-frequency oscillating means, second means for memorizing words representating the alloys of acceptable coins respectively, two combinations of parallel impedances respectively addressable from said alloy representating memorized words, an impedance bridge means excited by said oscillating means, and having one of its four arms including said two series-connected coils and two adjacent arms including said two parallel impedance combinations respectively, first means connected to said photoreceptive means and said first memorizing means for comparing said infed coin dimension representating word with all said acceptable coin dimension representating memorized words thereby refusing said infed coin or delivering to said second memorizing means the address of the acceptable coin alloy representative memorized word corresponding to the memorized word representating the dimensions of said infed coin, and bridge means balance detection means for comparing the detected alloy of said alloy coin with said alloy representated by said alloy representating memorized word addressed from said first comparing means thereby accepting or refusing said infed coin.

23. A multicoin discriminator as claimed in claim 22 wherein said step-shaped transversal cross-section is replaced by an inclined plane cross-section making a predetermined acute angle with said inclined side wall of said chute.

24. A multicoin discriminator comprising:

a chute having a down inclined track on which infed coins roll, an inclined side wall against which one face of said infed coins rests, and a step-shaped transversal track cross-section, whose lowest step is adjacent to said inclined side wall of said chute, two series-connected coils inserted on either side of said chute for detecting the alloy of each infed coin, predetermined-frequency oscillating means, first means for memorizing words representating the alloys of acceptable coins respectively, two combinations of parallel impedances respectively addressable from said alloy representating memorized words for each infed coin, an impedance bridge means excited by said oscillating means, and having one of its four arms including said two series-connected coils and two adjacent arms including said two parallel impedance combinations respectively, photoemissive means lodged in one of the side walls of said chute and in front of said step-shaped transversal cross-section, and following after said two coils in the infed coin run direction in said chute, photoreceptive means excitable by said photoemissive means and lodged in the other side wall of said chute and in front of said step-shaped transversal cross-section and said photoemissive means for detecting the diameter and the thickness of each infed coin thereby delivering an infed coin dimension representating word, second means for memorizing words representating the dimensions of acceptable coins respectively, bridge means balance detection means for comparing the detected alloy of each infed coin with all said alloys representated by said acceptable coin alloy representating memorized words thereby refusing said infed coin or delivering to said second memorizing means the address of the acceptable coin dimension representating memorized word corresponding to the memorized word representating the alloy of said infed coin, and means connected to said photoreceptive means and said second memorizing means for comparing said infed coin dimension representative word with said acceptable coin dimension representating memorized word addressed from said bridge means balance detection means thereby accepting or refusing said infed coin.

25. A multicoin discriminator as claimed in claim 24 wherein said step-shaped transversal cross-section is replaced by an inclined plane cross-section making a predetermined acute angle with said inclined side wall of said chute.

26. The multicoin discriminator claimed in claim 2 wherein the ends of the steps of said step-shaped transversal cross-section are interlinked to said chute track through longitudinal inclined planes.

27. The multicoin discriminator claimed in claim 3 wherein the ends of the steps of said step-shaped transversal cross-section are interlinked to said chute track through longitudinal inclined planes.

28. The multicoin discriminator claimed in claim 3 wherein the photosensitive receivers are charge transfer devices.

29. A multicoin discriminator as claimed in claim 3 comprising a slit perpendicular to the steps of said step-shaped transversal cross-section and make it one of the chute walls in front of said photoemissive means, said photosensitive receivers being aligned opposite to said slit in the other chute wall.

30. A multicoin discriminator as claimed in claim 3 comprising holes aligned perpendicular to the steps of said step-shaped transversal cross-section and make in one of the chute walls in front of said photoemissive means, said photosensitive receivers being respectively aligned opposite to said holes in the other chute wall.

31. The multicoin discriminator claimed in claim 3 wherein said photoemissive means emits in the infrared band.

32. The multicoin discriminator claimed in claim 12 wherein said photosensitive receivers are charge transfer devices.

33. A multicoin discriminator as claimed in claim 12 comprising a slit in one of said chute wall in front of said photosensitive means, said photoemissive receivers being aligned opposite to said slit in the other chute wall.

34. A multicoin discriminator as claimed in claim 12 comprising holes aligned in one of said chute walls in front of said photosensitive means, said photoemissive receivers being respectively aligned opposite to said holes in the other chute wall.

35. The multicoin discriminator claimed in claim 12 wherein said photoemissive means emits in the infrared band.

36. The multicoin discriminator claimed in claim 20 wherein said bridge means arm including said two coils comprises a thermistor.

37. A device for discriminating tokens having differing denominations, each discriminated denomination having a characteristic diameter and thickness, the device comprising:

a chute having a vertically inclined track on which the tokens roll and a generally vertical, slightly inclined wall against which one face of the tokens bears as the tokens roll on the inclined track;

a token sizing means for determining the denominations of the discriminated tokens in response to the diameters and thicknesses of the tokens as they roll on the inclined track, the token sizing means having a cross-section at right angles to the direction of the token rolls on the inclined track, the cross-section having surface means with components directed transverse and parallel to the inclined wall, each discriminated token having a different denomination bearing against different transverse and parallel portions of the surface means; and the token sizing means including means for detecting which of the transverse and parallel portions of the surface means the token bears against.

38. The device of claim 37 wherein the surface means has different portions with different heights relative to the inclined track and different thicknesses relative to the inclined wall so each discriminated token denomination occupies a different one of the portions as it rolls through the cross-section.

39. The device of claim 38 wherein the cross-section includes the inclined wall and a planar surface inclined at an acute angle relative to the inclined wall, the token bearing against the wall and planar as it rolls through the cross-section.

40. The device of claim 38 wherein the denomination determining means includes means for deriving first and second signal components respectively indicative of the magnitude of the diameter and thickness of the tokens rolling through the cross-section.

41. The device of claim 38 wherein the cross-section is shaped as a staircase having plural steps, each having a riser and landing, the spacings between the inclined wall and each riser being approximately equal and slightly in excess of the characteristic thicknesses, the spacings between adjacent landings being approximately equal and slightly in excess of the differences in radii of the characteristic diameters, the landing of the lowest step abutting against the inclined wall.

42. The device of claim 41 wherein the cross-section detecting means includes means for effectively detecting the landing on which the token bears.

43. The device of claim 38 wherein the cross-section is shaped as a plane inclined at an acute angle with respect to the inclined wall.

44. The device of claim 37 further including means for comparing the detected diameter and thickness of the token in the sizing means with stored values of diameter and thickness for the discriminated tokens.

45. The device of claim 37 wherein the token sizing means includes an energy source for illuminating at least one of the transverse and parallel portions of the surface means, and means for detecting where energy from the source is incident on the portions of the surface means.

46. The device of claim 45 wherein the energy source directs a generally horizontal beam of the energy transverse to the direction the token rolls, the energy beam extending vertically from the inclined track to a height at least equal to the diameter of the largest token to be discriminated, the diameter and thickness indicating signal components being respectively determined by means for detecting the extent of a region at right angles to the inclined track through which the token intercepts energy from the source and the extent of a zone between the inclined track to the bottom of the token through which the token does not intercept energy from the source.

47. The device of claim 46 wherein the detecting means is positioned on a first wall of the cross-section opposite from a second wall of the cross-section through which energy from the source is directed so that the diameter is indicated by detecting a reduction of the energy on the detecting means in the region and the thickness is indicated by detecting no reduction of the energy on the detecting means in the zone while the diameter is being detected in response to the energy reduction.

48. The device of claim 46 wherein the cross-section is shaped as a staircase having plural steps, each having a riser and landing, the spacings between the inclined wall and each riser being approximately equal to, and slightly in excess of the thicknesses of the characteristic thicknesses, the spacings between adjacent landings being aproximately equal to and slightly in excess of differences in radii of the characteristic diameters, the landing of the lowest step abutting against the inclined wall, the energy source illuminating each riser while no coin rolls on the inclined track.

49. The device of claim 47 wherein the cross-section is shaped as a plane inclined at the acute angle with respect to the inclined wall.

50. The device of claim 37 wherein the sizing means includes means for determining the diameter and thickness indicating signal components in response to the extent of a region at right angles to the inclined track that the token occupies as it rolls on the inclined track and the extent of a zone between the inclined track and the bottom of the token while the diameter is being detected.

51. A multicoin discriminator comprising a chute having a vertically inclined track on which coins roll, and an inclined side wall against which one face of said rests, and means including photoreceptive means and photoemissive means on opposite sides of said chute for detecting the dimensions of said coins, characterized in that said chute track in front of said dimension detecting means has an inclined plane cross-section making a predetermined acute angle with said inclined side wall of said chute, the photoreceptive means and track being arranged so that coins having different diameters cast shadows of differing length on the photoreceptive means and coins of different thicknesses cause differing lengths of the photoreceptive means to be illuminated by the photoemissive means.

* * * * *